US005615978A

United States Patent [19]

Kotani et al.

[11] Patent Number: 5,615,978

[45] Date of Patent: Apr. 1, 1997

[54] MANAGEMENT SYSTEM FOR WATER-BARRIER SHEET

[75] Inventors: Katsumi Kotani, Tokyo; Masatoshi Kushima, Kashiwa; Eiji Takahashi, Mitaka, all of Japan

[73] Assignee: Obayashi Corporation, Osaka, Japan

[21] Appl. No.: 401,256

[22] Filed: Mar. 9, 1995

[30] Foreign Application Priority Data

May 19, 1994 [JP] Japan ..... 6-105710

[51] Int. Cl.[6] ..... B65G 5/00; E21F 17/16

[52] U.S. Cl. ..... 405/270; 405/53; 405/129

[58] Field of Search ..... 405/270, 128, 405/129, 52, 53

[56] References Cited

U.S. PATENT DOCUMENTS

| | | | |
|---|---|---|---|
| 3,234,741 | 2/1966 | Ionides | 405/270 |
| 3,383,863 | 5/1968 | Berry | 405/270 |
| 4,916,937 | 4/1990 | Robertson et al. | 405/270 |
| 5,030,034 | 7/1991 | Bodine | 405/270 X |
| 5,076,728 | 12/1991 | Golding | 405/128 |
| 5,362,182 | 11/1994 | Hergenrother | 405/270 X |

FOREIGN PATENT DOCUMENTS

| | | |
|---|---|---|
| 6-63525 | 3/1994 | Japan . |
| 6-63526 | 3/1994 | Japan . |

*Primary Examiner*—Tamara L. Graysay
*Assistant Examiner*—Tara L. Mayo
*Attorney, Agent, or Firm*—Wenderoth, Lind & Ponack

[57] ABSTRACT

In a management system for a water-barrier sheet having a double layer structure with an upper sheet and a lower sheet, the interior space of the water-barrier sheet is hermetically sealed and divided into a plurality of enclosed divisions. A vacuum source introduces vacuum into each enclosed division. Pressure sensors monitor the vacuum condition in the inside of the respective enclosed divisions and a faulty division among them is identified by variation of the vacuum pressure when failure is caused. In response to detection and identification of the faulty division, a repair operation is performed. In case that penetration of water into the ground is not detected, temporary treatment for preventing the water penetration may be made by introducing pressurized air into the faulty division. For permanent repair of the division, water stop material is injected into the faulty division.

9 Claims, 5 Drawing Sheets

MANAGEMENT SYSTEM FOR WATER-BARRIER SHEET

BACKGROUND OF THE INVENTION

1. Field of the Invention

The present invention generally relates to a management system for a water-barrier sheet of double layer construction to be arranged in the bottom of a waste treatment plant, an impounding reservoir, and so forth, as which is divided into a plurality of hermetically sealed divisions. More specifically, the invention relates to a management system for a water-barrier sheet capable of identification of a damaged portion and preventing underground penetration of sewage through the damaged portion.

2. Description of the Related Art

In a land-filling type waste treatment plant, for example, where industrial and/or nonindustrial waste are disposed, it has been an obligation by applicable regulations to construct a water-barrier in the bottom of the field for preventing pollution due to underground penetration of sewage leaking from the waste. As such water-barrier, it has been typical to arrange a flexible synesthetic resin type or rubber type water-barrier sheet in view of economy and water-barrier characteristics. Also, in the bottom of facilities accumulating a large amount of water in a recessed portion, such as a water hazard in a golf course, an impounding reservoir, a holding pond, a pool and so forth, a water-barrier sheet similar to that employed in the waste treatment plant has been arranged for preventing leakage of the accumulated water.

However, in recent years, environmental pollution has been caused by leakage of the sewage and/or accumulated water due to rupture of the water-barrier sheet. As a solution for this, installation of a double layer type water barrier has been considered for enhancing safety by preventing leakage of sewage by a second layer sheet even when a first layer sheet is damaged.

As improvement of this idea, Japanese Laid-open Patent Publications (Kokai) Nos. 6-63525 and 6-63526 disclose an advanced type double layer water-barrier sheet which can provide higher reliability. In such arrangement, the double layer type water-barrier sheet is divided into a plurality of divisions isolated from each other in water-tight fashion so that even when the water-barrier sheet in one division is damaged, water-barrier performance in other divisions can be maintained with certainty. In addition, a water detecting means is provided in each individual division so that a damaged portion can be identified when leakage occurs so as to repair the damage by introducing a solidifying agent into the division identified as damaged.

Such arrangement is advantageous from the viewpoint of construction cost and operating cost. Namely, in the proposed construction, only a double layer water-barrier sheet is required initially. Therefore, the construction cost can be maintained at a level comparable with the conventional water-barrier construction. On the other hand, once a damaged division in the water-barrier sheet is identified, all that is required is to inject water stop agent into the damaged division. Therefore, the area to which the water stop agent is applied is limited so that the amount of the water stop agent to be used is significantly reduced. This is particularly advantageous when the facility where the water-barrier sheet is provided is large and thus the water-barrier sheet is required to cover a huge area.

However, in the related art, there is no well-systemized and well-established management system for managing damage and maintenance of the water-barrier sheet. In general, a waste treatment plant, an impounding reservoir and so forth are constructed over quite large areas. Therefore, the area to be covered with the water-barrier sheet also is quite large. Management of such water-barrier sheet by manual operation may become labor intensive and cause a significant increase of operating costs. There is a strong demand for a systematized management system for managing such double layer water-barrier sheet.

SUMMARY OF THE INVENTION

Therefore, it is a general object of the present invention to provide a management system for a water-barrier sheet which can solve the problems set forth above in the related art.

Another and more specific object of the present invention is to provide a management system for a water-barrier which can easily manage operating processes of detection or identification of a damaged portion in the water-barrier sheet and of preventing underground penetration of sewage by feeding a water stop agent into the identified portion of the water-barrier sheet.

In order to accomplish the above-mentioned and other objects, according to a first aspect of the invention, a management system for a water-barrier sheet having a double layer structure with an upper sheet and a lower includes first means for hermetically sealing and dividing an interior space of the water-barrier sheet defined between the upper and lower sheet into a plurality of enclosed divisions. A second means applies a vacuum pressure to enclosed interior spaces of respective enclosed divisions. A third means monitors vacuum condition in the interior spaces of respective enclosed divisions and identifying a faulty division when a failure occurs. A fourth means performs a repair operation, responsive to the third means detecting and identifying failure in one division.

The management system may further comprise fifth means for sampling water penetrating into the faulty division. Also, the fourth means may include means for feeding pressurized air into the interior space of the faulty division to provide resistance against penetrating water pressure.

According to a second aspect of the invention, a management system for a water-barrier sheet of double layer structure with an upper sheet and a lower sheet, in which the water-barrier sheet is placed on a bottom of a ground cavity for preventing liquid substance within the ground cavity from penetrating into the ground, includes a plurality of hermetically sealed separate divisions defined within the water-barrier sheet between the upper and lower sheets. A plurality of tubular passages each have one end opening into a respective one of the plurality of individual divisions. A vacuum source for generating a vacuum pressure to be introduced into respective of the individual divisions. A pressurized air source generates pressurized air to be introduced into each of the individual divisions. Switching valves selectively establish and switch communication of each tubular passage with the vacuum source and the pressurized air source. Each of the switching valves is operable at least between a first position for establishing communication between the tubular passage and the vacuum source and a second position for establishing communication between the tubular passage and the pressurized air source. Failure detectors monitor pressure conditions in the tubular passages and detect failure of sealing on the basis of variation of the vacuum pressure, thus for identifying one of the individual divisions where failure of sealing occurs. A computer system controls the respective switching valve to switch to the first position thereof in the normal state of monitoring the sealing condition in each of the individual divisions, and is responsive to the failure detector detecting failure in one of the individual divisions to switch the switching valve corresponding to the faulty individual division to the second position thereof, for providing resistance against penetration of the liquid substance into the individual division with sealing failure.

According to a third aspect of the invention, a management system for a water-barrier sheet of double layer structure with an upper sheet and a lower sheet, which water-barrier sheet is placed on a bottom of a ground cavity for preventing liquid substance within the ground cavity from penetrating into the ground, includes a plurality of hermetically sealed separate divisions defined within the water-barrier sheet between the upper and lower sheets. A plurality of tubular passages each have one end opening into a respective one of the plurality of separate divisions. A vacuum source for generates vacuum pressure to be introduced into each of the separate divisions. A water stop material source feeds water stop material into the separate divisions while pressurized. Failure detectors monitor pressure conditions in the tubular passages and detect failure of sealing on the basis of variation of the vacuum pressure, thus identifying one of the separate divisions where sealing failure occurs. Connectors are provided at the other ends of the tubular passages to be selectively connected to the vacuum source or to the water stop material source. The connectors are normally connected to the vacuum source for introducing vacuum pressure into each of the separate divisions, and being connected to the water stop material source upon occurrence of sealing failure in the corresponding separate division. A computer system controls the vacuum source and the water stop material source. The computer system normally operates the vacuum source to introduce vacuum pressure into the separate divisions and is responsive to the failure detector to operate the water stop material source to introduce the water stop material into the faulty separate division.

A plurality of separate divisions may be hermetically sealed and separated by bonding of the upper and lower sheets along a plurality of bonding lines extending both in longitudinal and in lateral directions at a given pitch. The vacuum source may comprise a vacuum pump, a common line connected at one end and thereof to the vacuum pump and a plurality of branched lines respectively connected to the tubular passages. The failure detector may include a first pressure sensor monitoring the pressure in the common line for detecting the occurrence of sealing failure and a plurality of second pressure sensors respectively monitoring the pressure in the branched lines for identifying a faulty separate division when the occurrence of the sealing failure is detected by the first sensor.

The water stop material may be a material selected among a cement type solidification agent and a resin type solidification agent.

According to a fourth aspect of the invention, a management system for a water-barrier sheet of double layer structure with an upper sheet and a lower sheet, in which the water-barrier sheet is placed on a bottom of a ground cavity for preventing liquid substance within the ground cavity from penetrating into the ground, includes a plurality of hermetically sealed separate divisions defined within the water-barrier sheet between the upper and the lower sheets. A plurality of tubular passages each have one end opening into a respective one of the separate divisions. A vacuum source generates vacuum pressure to be introduced into each of the separate divisions. A pressurized air source generates pressurized air to be introduced into each of the separate divisions. Switching valves selectively establish or block communication of each tubular passage with the vacuum source and the pressurized air source. Each of the switching valves is operable at least between a first position for establishing communication between the tubular passage and the vacuum source and a second position for establishing communication between the tubular passage and the pressurized air source. A water stop material source feeds water stop material into the separate divisions while pressurized. Failure detectors monitor pressure conditions in the tubular passages and detect failure of sealing on the basis of variation of the vacuum pressure, thus identifying one of the separate divisions where sealing failure occurs. Connectors are provided at the other ends of the tubular passages to be selectively connected to the vacuum source or to the water stop material source. The connectors are normally connected to the vacuum source for introducing vacuum pressure into each of the separate divisions, and are connected to the water stop material source upon occurrence of sealing failure in the corresponding separate divisions. A computer system normally operates the vacuum source for introduce vacuum pressure into the separate divisions for monitoring the sealing condition of the respective separate divisions. The computer system is responsive to the failure detector for selectively performing a first mode fail-safe operation to operate the water stop material source for introducing water stop material into the faulty separate division for emergency treatment and a second mode fail-safe operation to operate the water stop material source for introducing water stop material into the faulty separate division for permanent repair.

According to a fifth aspect of the invention, a management system for a water-barrier sheet of double layer structure with an upper sheet and a lower sheet, in which the water-barrier sheet is placed on a bottom of a ground cavity for preventing liquid substance within the ground cavity from penetrating into the ground, includes a plurality of hermetically sealed separate divisions defined within the water-barrier sheet between the upper and lower sheets. A plurality of vacuum passages each have one end opening into a respective one of the separate divisions. A vacuum source is connected to other ends of the vacuum passages for introducing vacuum pressure into each of the separate divisions. Vacuum detectors monitor vacuum pressure in the vacuum passages for detecting sealing failure on the basis of variation of the vacuum pressure, to thus identify one of the separate divisions where sealing failure occurs.

BRIEF DESCRIPTION OF THE DRAWINGS

The present invention will be understood more fully from the detailed description given herebelow and from the accompanying drawings of the preferred embodiments of the invention, which, however, should not be taken to be limitative to the present invention, but are for explanation and understanding only.

In the drawings.

DETAILED DESCRIPTION OF THE PREFERRED EMBODIMENTS OF THE INVENTION

The present invention will be discussed hereinafter in detail in terms of the preferred embodiments with reference to the accompanying drawings. In the following description, numerous specific details are set forth in order to provide thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
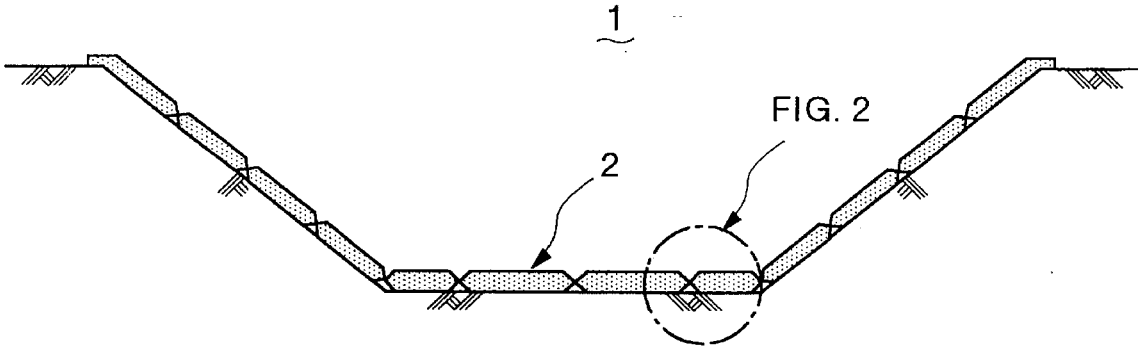
FIG. 1 is a general section showing one example of a waste treatment plant employing the management system according to the present invention.
Figure 3:
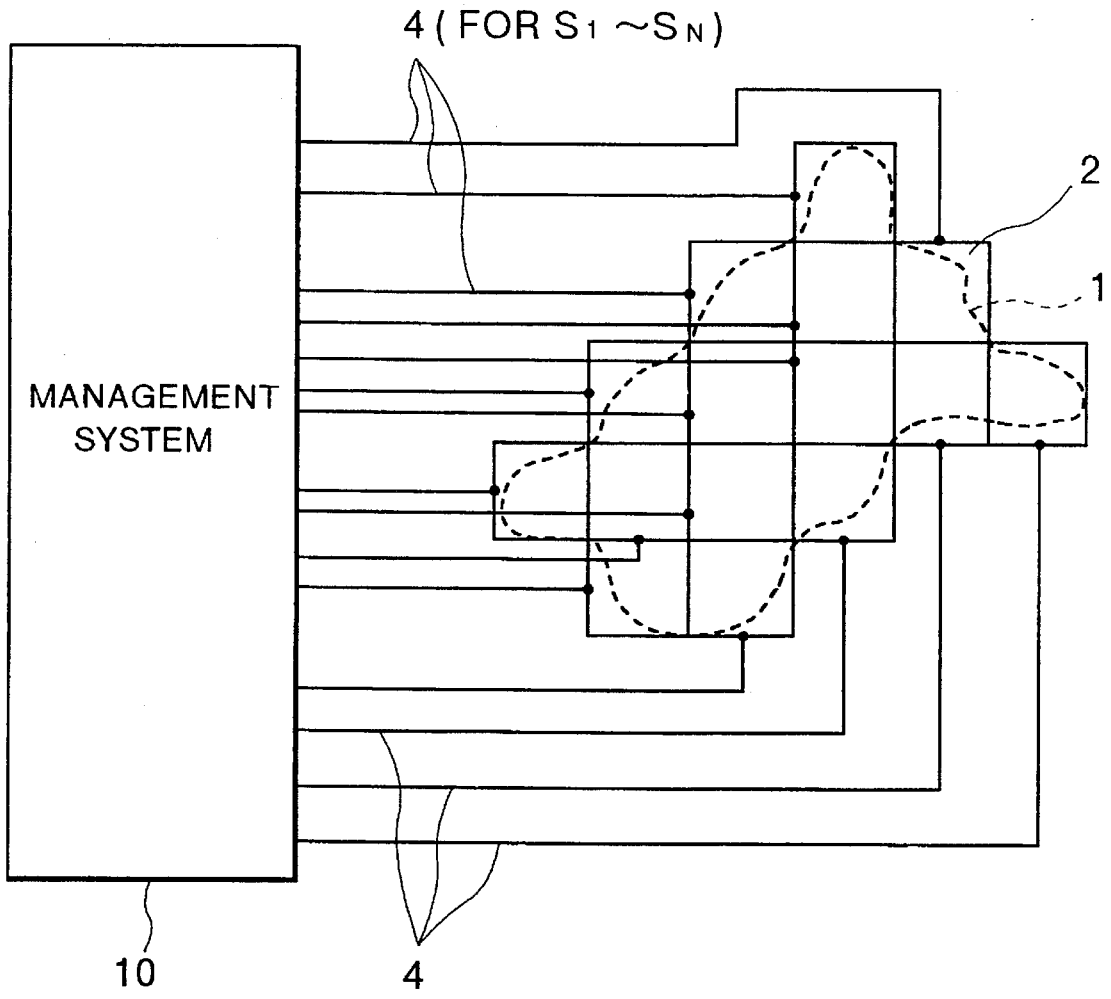
FIG. 3 is a schematic plan view of the waste treatment plant of FIG. 1.

Referring to the drawings, FIG. 1 is a general section showing one embodiment of a land-fill type waste treatment plant, including a preferred embodiment of a management system for a water-barrier sheet according to the present invention, and FIG. 3 is a schematic plan view of the waste treatment plant with the preferred embodiment of the management system. In the shown construction, a waste treatment plant 1 is constructed by excavating and landscaping a very wide area to form a huge bowl-like configuration for defining a waste receptacle concave. On the bottom of the waste receptacle concave, a water-barrier sheet assembly 2 is arranged. The water-barrier sheet assembly 2 extends over the entire bottom area of the water receptacle concave including the ascending circumferential slope thereof. Waste is disposed on the water-barrier sheet assembly 2 in order to fill the concave.

Figure 2:
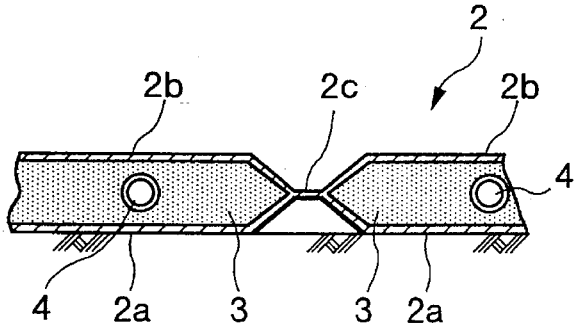
FIG. 2 is an enlarged partial section showing the major part of a water-barrier sheet employed in the waste treatment plant of FIG. 1.

As shown in the partial enlarged view of FIG. 2, the water-barrier sheet assembly 2 is generally a double layer sheet including a lower sheet 2*a* directly laid on the bottom surface of the water receptacle concave and an upper sheet 2*b* arranged above the lower sheet 2*a*. Both of the lower sheet 2*a* and the upper sheet 2*b* are formed of soft synthetic resin type or rubber type flexible sheet. The upper sheet 2*b* is secured to the lower sheet 2*a* at bonding lines 2*c* extending in longitudinal and lateral directions by welding or other appropriate means after fixing the lower sheet 2*a* on the bottom of the waste receptacle concave. At each of the bonding lines 2*c*, the lower sheet 2*a* and the upper sheet 2*b* are fastened in air-tight fashion to define a plurality of bag-like enclosed divisions $S_1$ to $S_N$. Each of the bag-like enclosed divisions $S_1$ to $S_N$ is filled with a sheet-shaped protective mat 3 of non-woven fabric or so forth. It should be noted that the pitches of the longitudinally extending bonding lines and the laterally extending bonding lines for defining an array of the bag-like enclosed divisions are set in view of the total area of the waste receptacle concave, efficiency of management and other factors. For instance, an enclosed division of small area is preferred for efficiency of repair upon failure such as rupture of the water-barrier sheet, and for quick detection of the failure. To the contrary, in view of construction efficiency and economy, an enclosed division of large area is preferable.

In addition, to each of the bag-like enclosed divisions $S_1$ to $S_N$ is inserted one end of a respective monitoring hose 4. The other end of each monitoring hose 4 is connected to a management system 10 as a preferred embodiment of the present invention, which is located outside the waste treatment plant 1.

It should be noted that FIG. 3 schematically shows the water-barrier sheet assembly 2 arranged in the waste treatment plant 1 having a configuration as illustrated by a broken line. As can be seen, the water-barrier sheet assembly 2 extends over the entire area of the waste receptacle concave in the waste treatment plant 1. The bag-like enclosed divisions $S_1$ to $S_N$ of the water-barrier sheet assembly 2 form an array through the entire area covered by the water-barrier sheet assembly 2. As shown in FIG. 3, each of the monitoring hoses 4 is connected to a respective corresponding one of the bag-like enclosed divisions $S_1$ to $S_N$.

Figure 4:
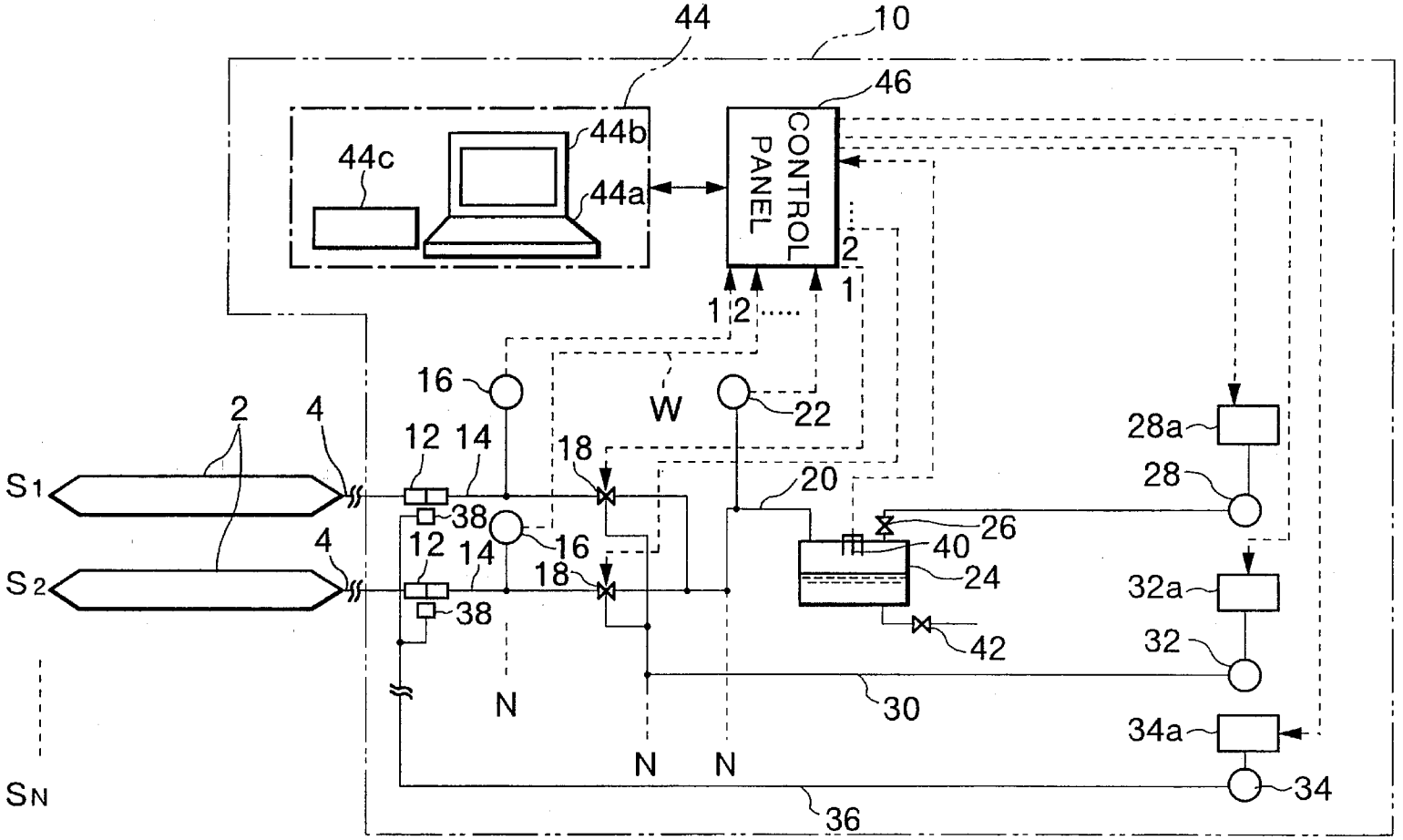
FIG. 4 is a schematic block diagram of the preferred embodiment of the management system of FIG. 1.

FIG. 4 schematically shows a preferred embodiment of the water-barrier sheet management system according to the present invention. The monitoring hoses 4 are respectively connected to management pipes 14 via connecters 12. A vacuum sensor 16 and an electromagnetic switching valve 18 are provided in this order from the tip or outer end side of each management pipe 14. The management pipes 14 are assembled or connected to a single common suction pipe 20.

The suction pipe 20 is connected to a vacuum pump 28 via a main vacuum sensor 22, a water collection tank 24, a main valve 26 and so forth.

The electromagnetic switching valve 18 is connected at one switching port thereof to the suction pipe 20. The electromagnetic switching valve 18 is also connected at another switching port thereof to a high pressure hose 30. The electromagnetic switching valve 18 is an electrically operated three-way valve for selectively establishing communication between the management pipe 14 and the suction pipe 20 or the high pressure hose 30 and for blocking communication therebetween. The high pressure hose 30 is connected to a compressor 32 for supplying pressurized air to the respective enclosed divisions $S_1$ to $S_N$.

On the other hand, the connector 12 of each monitoring hose 4 is designed to be coupled with a connector 38 at one end of a feed hose 36. The other connector 38 is provided at the other end of the feed hose 36 for connection with a feed pump 34 for feeding a water stop agent such as a solidification agent.

The water collection tank 24 is an enclosed tank for storing liquid to be examined. A liquid level sensor 40 is provided at the upper portion of the water collection tank 24. On the other hand, a discharge valve 42 for sampling such liquid and for draining the stored liquid is provided at the lower portion of the water collection tank 24.

Measured values of respective sensors are input to a management computer system 44 via a control panel 46 from time to time. The management computer system 44 and the control panel 46 may be located in a administration office building or so forth. The computer system 44 includes a keyboard 44*a*, a display device 44*b*, a printer 44*c*, a memory device (not shown) and so forth. In the memory device of the computer system 44 is stored initial data of respective bag-like enclosed divisions $S_1$ to $S_N$ of the water-barrier sheet assembly 2. The display device 44*b* may display the registered divisions graphically as illustrated in FIG. 3 so that a faulty division can be visually identified at a glance.

The computer system 44 controls valve positions of the respective valves. The computer system 44 also controls operation of the vacuum pump 28 via a vacuum pump control portion 28*a*. Similarly, the computer system 44 controls operation of the compressor 32 via a compressor control portion 32*a* and operation of the solidification agent feed pump 34 via a feed pump control portion 34*a*.

Figure 5:
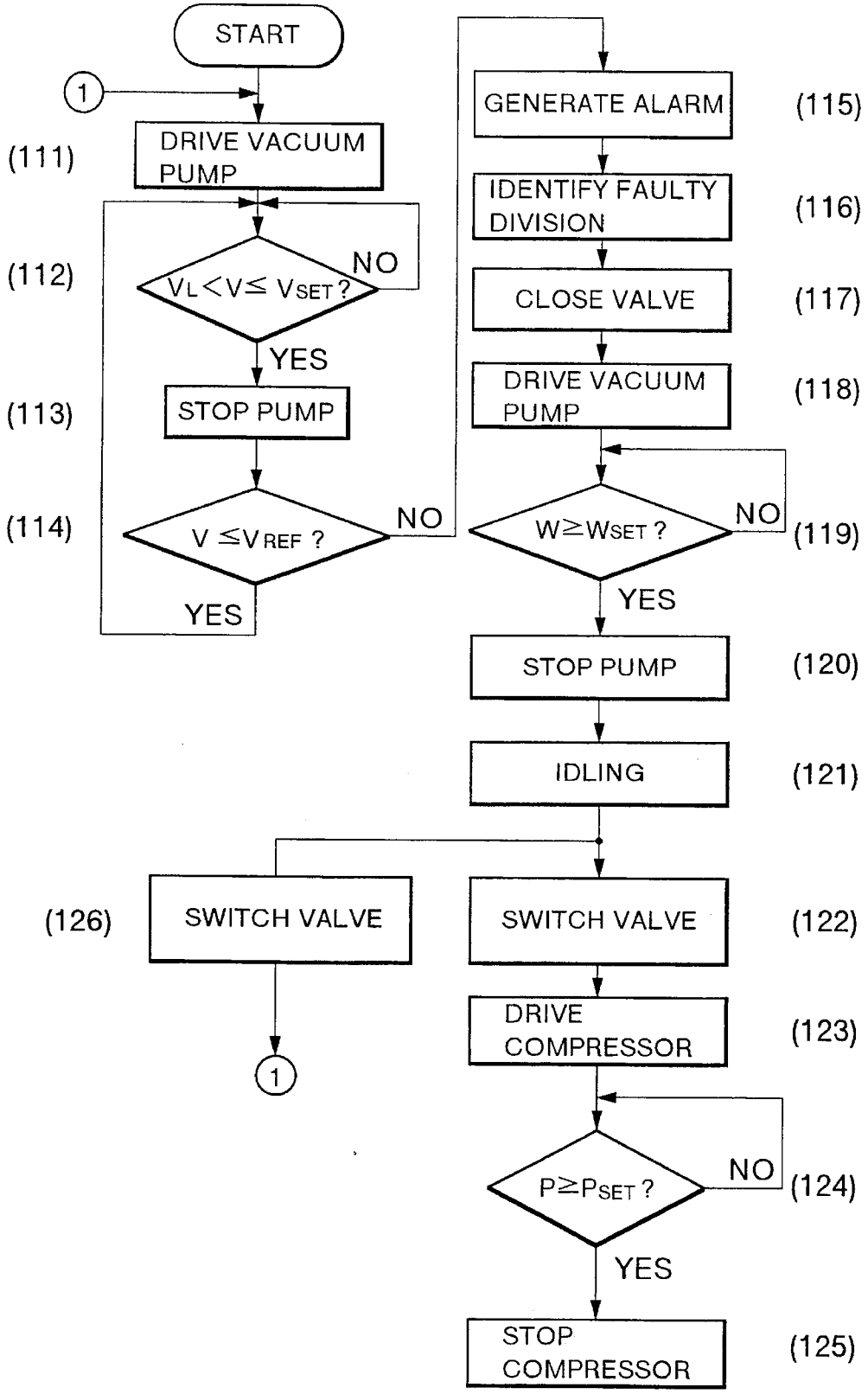
FIG. 5 is a flow chart showing a procedure of an emergency repair in the management system.
Figure 6:
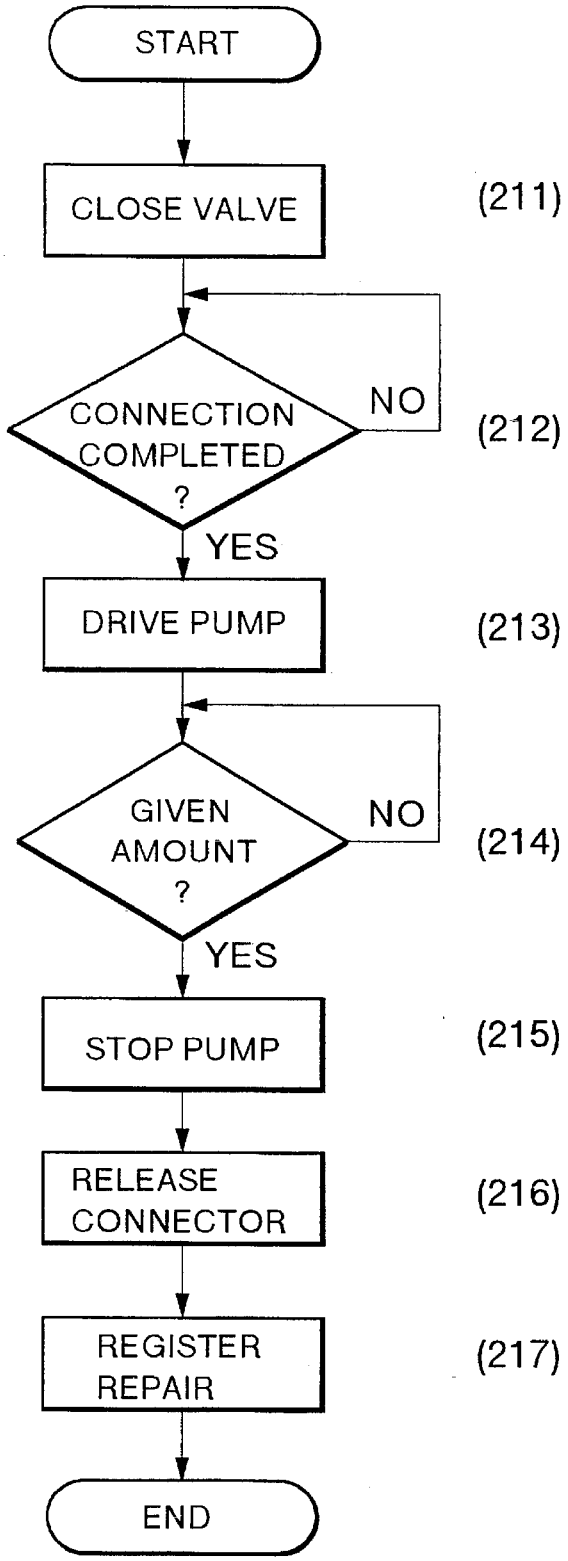
FIG. 6 is a flow chart showing a procedure of a permanent repair operation in the management system.

FIGS. 5 and 6 show procedures in the preferred embodiment of the management system illustrated in FIG. 4. FIG. 5 shows a procedure of an emergency repair upon failure of one enclosed division. After laying the water-barrier sheet assembly 2 and checking air-tightness of respective divisions $S_1$ to $S_N$, the computer system 44 is activated. Then, the respective electromagnetic switching valves 18 are switched into positions for establishing communication between the monitoring pipes 14 and the suction pipe 20 by keyboard operation and so forth. After that, the vacuum pump 28 is driven via the vacuum pump control portion 28*a* for generating vacuum pressure at step 111 in FIG. 5.

By this, vacuum pressure is introduced into each of the bag-like enclosed divisions $S_1$ to $S_N$. The vacuum pressure in the suction pipe 20 is monitored by the vacuum sensor 22. The computer system 44 periodically checks the vacuum pressure in the suction pipe 20 to determine whether the vacuum pressure reaches a preliminarily set value ($V_{set}$) at step 112. When the measured vacuum pressure reaches the value ($V_{set}$), the computer system 44 operates the vacuum pump control portion 28*a* to stop driving of the vacuum pump 28 at step 113. As can be appreciated, even when the water-barrier sheet assembly 2 is in normal condition, the degree of vacuum is naturally lowered gradually. When the degree of vacuum in the suction pipe 20 is lowered across a predetermined lower limit ($V_L$) detected at the step 112, the computer system 44 again operates the vacuum pump control portion 28*a* to drive the vacuum pump 28. Therefore, through the steps 111 to 114, the vacuum pressure level V in the suction pipe 20 can be automatically maintained within a predetermined range defined by the set pressure $V_{set}$ and the lower limit $V_L$.

After completion of initial setting for monitoring operation, positioning of waste into the waste receptacle concave is started. After starting the monitoring operation, the vacuum pressure in the suction pipe 20 is measured continuously. When failure, such as rupture, of the water-barrier sheet 2 occurs in some division, the degree of vacuum in the suction pipe 20 will drop abruptly. Dropping of the degree of vacuum due to failure of a division can be distinguished from natural lowering of the degree of vacuum by drop rate $\Delta V$. Therefore, the computer system 44 checks the rate of drop of the degree of vacuum in a predetermined unit period at step 114.

After initiation of the monitoring operation, the steps 111 to 114 are repeated as long as the drop rate $\Delta V$ of the degree of vacuum is maintained smaller than or equal to a predetermined failure detection level $\Delta V_{ref}$. On the other hand, when a drop rate $\Delta V$ greater than the failure detection level $\Delta V_{ref}$ is detected at step 114, the computer system 44 causes an alarm at step 115.

Then, the computer system 44 checks respective inputs from the vacuum sensors 16 monitoring vacuum pressure in the respective management pipes 14 for identifying one of the management pipes 14 in which the substantial drop of the degree of vacuum is caused at step 116. By this, the faulty division can be identified. Then, the computer system 44 displays the identified faulty division on the display device 44*b*.

Thereafter, all of the electromagnetic switching valves 18 except for that corresponding to the identified faulty division are operated at shut-down state to block communication between the management pipes 14 and the suction pipe 20 at step 117. Then, the vacuum pump 28 is driven to introduce vacuum only into the faulty division for sucking water that has been penetrated into the internal space of the faulty division due to failure of either the upper sheet 2*b* or the lower sheet 2*a* at step 118. By this operation, the penetrating water in the faulty division is collected in the water collection tank 24. Then, the collected water level is determined on the basis of the output of the liquid level sensor 40, at step 119. Suction of the penetrated water is continued until sufficient water for examination is stored in the water collection tank 24. When the collected water level W reaches a predetermined level $W_{set}$ as determined at step 119, the vacuum pump 28 is stopped at step 120.

After stopping of the vacuum pump 28, elapsed time is measured for waiting a predetermined period $T_{set}$ at step 121. The elapsed time may be measured by an internal timer in the computer system 44, or alternatively by a separate timer. After expiration of the predetermined period $T_{set}$, the electromagnetic switching valve 18 corresponding to the faulty division is operated to change the valve position for establishing communication between the management pipe 14 and the high pressure hose 30 at step 122. Thereafter, the compressor 32 is activated via the compressor control portion 32*a* to introduce high pressure air into the faulty division at step 123. By introduction of the pressurized air generated by the compressor 32, a resisting pressure against the penetrating water pressure can be built up in the faulty division. When the pressure level P reaches a predetermined set pressure $P_{set}$ is detected at step 124, the compressor 32 is stopped at step 125.

On the other hand, after expiration of the predetermined period $T_{set}$, the electromagnetic switching valves 18 corresponding to the divisions other than the faulty division are switched at step 126 to establish communication between the management pipes 14 and the suction pipe 20 to resume the normal monitoring state.

Meanwhile, the water collected in the water collection tank 24 is examined. When the collected water is underground water, a judgement can be made that rupture in the division is in the lower sheet 2*a*. When the pressure drop rate during the duration of non-operation of the compressor 32 is small, it can be determined that rupture hole is not significantly large. Repair work for of the rupture may not be necessary in such occasion.

However, when the collected water is found to be sewage from the waste due to the rupture being in the upper sheet 2*b*, or when the pressure drop rate while the compressor 32 is not operated is large enough to indicate that the rupture hole in the lower sheet 2*a* is significantly large, repair should be performed through the procedure as illustrated in FIG. 6.

When a decision is made that an immediate repair operation is required, the electromagnetic switching valve 18 corresponding to the faulty division is operated to disconnect the corresponding management pipe 14 from both the suction pipe 20 and the high pressure hose 30 at step 211. Then, by manual operation, the corresponding connector 12 is disconnected from the management pipe 14 and connected to the feed hose 36 by engagement with the connector 38. After connection of the monitoring hose 4 to the feed hose 36, the completion of connection may be input to the computer system 44 via the keyboard 44*a* to make the computer system 44 stay in a waiting state until completion of connection between the monitoring hose 4 and the feed hose 36 is determined. Upon completion of connection at step 212, the computer system 44 operates the feed pump 34 via the feed pump control portion 34*a* at step 213. Thus, the feed pump 34 starts to feed water stop material into the faulty division via the hose 36 and the monitoring hose 4. The feed amount of the water stop material fed is monitored in known manner while the water stop material is fed into the faulty division. When the feed amount reaches a predetermined amount which is determined depending upon the volume of the faulty division as detected at step 214, the computer system 44 operates the feed pump control portion 34*a* to stop the feed pump 34 at step 215. Thereafter, the connector 12 is disconnected from the connector 38 for disengaging the monitoring hose 4 from the feed hose 36 at step 216. The fact that a repair operation is performed for the faulty division is registered in the computer system 44 through the keyboard 44*a* at step 217. The repair operation is thus completed.

As set forth above, the management system for the water-barrier sheet assembly according to the present invention enables monitoring each separate division in the water-barrier sheet assembly in a manner that failure of the sheet assembly can be quickly detected by identifying the faulty division. This configuration significantly facilitates a repair operation to be performed for the faulty division. Also, because the repair operation can dispense with the need for direct access to the faulty division for a manual operation and can be done remotely, the repair operation can be performed without interrupting operation of the overall waste treatment plant. Furthermore, the only required manual operation for repair is only changing connection of the hoses. Thus the repair operation can be significantly simplified and facilitated.

In addition, the shown embodiment enables identification of the faulty sheet, i.e. either the upper sheet or the lower sheet by the water quality test. On the basis of the result of the water quality test, the repair mode can be also selected.

Although the invention has been illustrated and described with respect to an exemplary embodiment thereof, it will be understood by those skilled in the art that the foregoing and various other changes, omissions and additions may be made therein and thereto, without departing from the spirit and scope of the present invention. Therefore, the present invention should not be understood as limited to the specific embodiment set forth above but to include all possible embodiments which can be embodied within a scope encompassed by and equivalents thereof with respect to the features set forth in the appended claims.

It should be noted that a cement type solidification agent or a resin type solidification agent such as urethane resin, high water absorption resin, epoxy resin, polyester resin and so forth may be employed as the water stop material.

In addition, the computer 44 constantly monitors the vacuum condition in each of the divisions $S_1$ to $S_N$ to derive a rate of variation thereof for generating daily, weekly and/or monthly reports. The report may be displayed on the display device 44*b* and may be printed by the printer 44*c* at any time.

As set forth above, the shown embodiment provides a procedure to, upon occurrence of failure in one enclosed division, initially feed pressurized air to resist the incoming water pressure, then perform a quality test of the water sampled from the division, and then perform solidification with the solidification agent as the result of test requires. Such procedure is established in view of two modes of failure, one of which may require immediate repair and the other of which may not. However, it is of course possible to modify the above-mentioned procedure to perform a repair operation by the water stop material whenever the failure of one division is detected.

Also, while the foregoing embodiment has been discussed with respect to application of a management system for a water-barrier sheet for a waste treatment plant, the present invention is equally applicable to other water storage facilities such as a water hazard in a golf course, a variety of impounding reservoirs, an irrigation pond, and so forth.

What is claimed is:

1. A management system for a water-barrier sheet having a double layer structure with an upper sheet and a lower sheet, said system comprising:

first means for hermetically sealing and dividing an interior space of said water-barrier sheet defined between said upper and lower sheets into a plurality of enclosed divisions;

second means for applying vacuum pressure to enclosed interior spaces of said respective enclosed divisions;

third means for monitoring vacuum conditions in said interior spaces of said respective enclosed divisions and identifying a faulty division when failure thereof occurs;

fourth means, responsive to said third means, for performing a repair operation of a failure in said faulty division, said fourth means including means for feeding pressurized air into said interior space of said faulty division for forming a resistance against water pressure penetrating into said faulty division; and fifth means for sampling water penetrating into said faulty division.

2. A management system for a water-barrier sheet of double layer structure with an upper sheet and a lower sheet, in which said water-barrier sheet is placed on a bottom of a ground cavity for preventing liquid substance within the ground cavity from penetrating into the ground, said system comprising:

a plurality of hermetically sealed separate compartments defined within said water-barrier sheet between said upper and lower sheets;

a plurality of tubular passages each having one end opening into a respective one of said plurality of respective compartments;

a vacuum source for generating a vacuum pressure to be introduced into each of said compartments;

a pressurized air source for generating pressurized air to be introduced into each of said compartments;

switching valves for selectively establishing and blocking communication of respective said tubular passages with said vacuum source and said pressurized air source, each of said switching valves being operable at least between a first position establishing communication between said respective tubular passage and said vacuum source and a second position establishing communication between said respective tubular passage and said pressurized air source;

failure detectors monitoring pressure conditions in said tubular passages for detecting failure of sealing on the basis of variation of the vacuum pressure and thus for identifying one of said compartments where failure of sealing occurs; and a computer system controlling said switching valves for placing said switching valves in said first position in a normal state for monitoring sealing conditions in each of said compartments, and responsive to said failure detectors detecting failure in one of said compartments for switching the valve position of the respective said switching valve corresponding to said faulty compartment to said second position for providing resistance against penetration of the liquid substance into said compartment upon sealing failure.

3. A management system for a water-barrier sheet as set forth in claim 2, wherein said plurality of compartments are sealingly separated by bonding of said upper and lower sheets along a plurality of bonding lines extending in longitudinal and lateral directions at a given pitch.

4. A management system for a water-barrier sheet as set forth in claim 2, wherein said vacuum source comprises a vacuum pump, a common line connected at one end thereof to said vacuum pump and a plurality of branched lines connected to respective said tubular passages, and said failure detector includes a first pressure sensor monitoring pressure in said common line for detecting occurrence of failure and a plurality of second pressure sensors respectively monitoring pressure in said branched lines for identifying faulty individual compartments when occurrence of failure is detected by said first pressure sensor.

5. A management system for a water-barrier sheet of double layer structure with an upper sheet and a lower sheet, in which said water-barrier sheet is placed on a bottom of a ground cavity for preventing liquid substance within the ground cavity from penetrating into the ground, said system comprising:

a plurality of hermetically sealed separate compartments defined within said water-barrier sheet between said upper and lower sheets;

a plurality of tubular passages each having one end opening into a respective one of said plurality of separate compartments;

a vacuum source for generating vacuum pressure to be introduced into each of said compartments;

a water stop material source for feeding water stop material into a said separate compartment under pressure;

failure detectors monitoring pressure conditions in said tubular passages for detecting failure of sealing on the basis of variation of the vacuum pressure and thus for identifying one of said separate compartments where sealing failure occurs;

connectors provided at other ends of said tubular passages to be selectively connected to said vacuum source and to said water stop material source, said connectors normally being connected to said vacuum source for introducing vacuum pressure into each of said separate compartments and being connected to said water stop material source upon occurrence of sealing failure of a corresponding said separate compartment; and a computer system controlling said vacuum source and said water stop material source, said computer system normally operating said vacuum source for introducing vacuum into said separate compartments and responsive to said failure detector to operate said water stop material source for introducing water stop material into a faulty said compartment.

6. A management system for a water-barrier sheet as set forth in claim 5, wherein said plurality of separate compartments are sealingly separated by bonding of said upper and lower sheets along a plurality of bonding lines extending in longitudinal and lateral directions at a given pitch.

7. A management system for a water-barrier sheet as set forth in claim 5, wherein said vacuum source comprises a vacuum pump, a common line connected at one end thereof to said vacuum pump and a plurality of branched lines connected to respective said tubular passages, and said failure detector includes a first pressure sensor monitoring pressure in said common line for detecting occurrence of failure and a plurality of second pressure sensors respectively monitoring pressure in said branched lines for identifying faulty individual compartments when occurrence of sealing failure is detected by said first pressure sensor.

8. A management system for a water-barrier sheet as set forth in claim 5, wherein said water stop material is material including a cement type solidification agent or a resin type solidification agent.

9. A management system for a water-barrier sheet of double layer structure with an upper sheet and a lower sheet, which water-barrier sheet is placed on a bottom of a ground cavity for preventing liquid substance within the ground cavity from penetrating into the ground, said system comprising:

a plurality of hermetically sealed separate compartments defined within said water-barrier sheet between said upper and lower sheets;

a plurality of tubular passages each having one end opening to a respective one of said plurality of separate compartments;

a vacuum source for generating vacuum pressure to be introduced into each of said separate compartments;

a pressurized air source for generating pressurized air to be introduced into each of said separate compartments;

switching valves for selectively establishing and blocking communication of respective said tubular passages with said vacuum source and said pressurized air source, each of said switching valves being operable at least between a first position establishing communication between said respective tubular passage and said vacuum source and a second position establishing communication between said respective tubular passage and said pressurized air source;

a water stop material source for feeding water stop material into a said separate compartment under pressure;

failure detectors monitoring pressure conditions in said tubular passages for detecting sealing failure on the basis of variation of the vacuum pressure and thus for identifying one of said separate compartments where sealing failure occurs;

connectors provided at other ends of said tubular passages to be selectively connected to said vacuum source and to said water stop material source, said connectors normally being connected to said vacuum source for introducing vacuum pressure into each of said separate compartments and being connected to said water stop material source upon occurrence of sealing failure of a corresponding said separate compartment; and a computer system normally operating said vacuum source for introducing vacuum into said separate compartments for monitoring sealing conditions of said respective separate compartments, said computer system being responsive to said failure detectors for selectively performing a first mode fail-safe operation to operate said pressurized air source for introducing pressurized air into a faulty said separate compartment for emergency treatment and a second mode fail-safe operation to operate said water stop material source for introducing water stop material into said faulty separate compartment for permanent repair.

* * * * *